US010975872B2

(12) United States Patent
Christiansen

(10) Patent No.: US 10,975,872 B2
(45) Date of Patent: Apr. 13, 2021

(54) CONDENSATE RECOVERY SYSTEM AND METHOD

(71) Applicant: Stephen Christiansen, Savannah, GA (US)

(72) Inventor: Stephen Christiansen, Savannah, GA (US)

( * ) Notice: Subject to any disclaimer, the term of this patent is extended or adjusted under 35 U.S.C. 154(b) by 299 days.

(21) Appl. No.: 15/984,731

(22) Filed: May 21, 2018

(65) Prior Publication Data

US 2018/0340537 A1 Nov. 29, 2018

Related U.S. Application Data

(60) Provisional application No. 62/511,635, filed on May 26, 2017.

(51) Int. Cl.

| | |
|---|---|
| ***F04D 13/16*** | (2006.01) |
| ***F25D 21/14*** | (2006.01) |
| ***F24F 13/22*** | (2006.01) |
| ***F04D 15/02*** | (2006.01) |

(52) U.S. Cl.

CPC ..... *F04D 13/16* (2013.01); *F04D 15/0218* (2013.01); *F24F 13/222* (2013.01); *F25D 21/14* (2013.01); *F24F 2013/227* (2013.01)

(58) Field of Classification Search

CPC ..... F04D 13/16; F04D 15/0218; F04D 15/02; F24F 13/22; F24F 13/222; F24F 2013/227; F24F 2140/30; F25D 21/14; F04B 49/025; F04B 49/04

USPC ..... 62/150; 137/398

See application file for complete search history.

(56) References Cited

U.S. PATENT DOCUMENTS

| | | | | |
|---|---|---|---|---|
| 6,065,299 | A * | 5/2000 | Chen | F24F 13/224 62/277 |
| 2002/0000093 | A1* | 1/2002 | Lea | F24F 13/222 62/150 |
| 2003/0209020 | A1* | 11/2003 | Klein | F25J 3/04018 62/183 |
| 2008/0104988 | A1* | 5/2008 | Lee | F24F 1/04 62/285 |
| 2011/0308618 | A1* | 12/2011 | Lorenz | E03B 1/042 137/1 |
| 2012/0230846 | A1* | 9/2012 | Stephens | A62C 35/60 417/279 |

* cited by examiner

*Primary Examiner* — Philip E Stimpert

(74) *Attorney, Agent, or Firm* — The Law Offices of John G. Posa

(57) ABSTRACT

A condensate recovery system is adapted for use with an existing drain. A condensate collection vessel, which may be funnel-shaped, is inserted into the existing drain includes an upper opening to receive condensate and an outer wall. At least a portion of the outer wall is spaced apart from the inner wall of the drain such that if the collection vessel overflows, the excess liquid flows into the drain. A float switch is operative to detect when the vessel has been filled with condensate, and a pump is operative to drain the vessel in response to the float switch detecting that the vessel has been filled with condensate. A time delay relay (TDR) may be activated for a predetermined period of time before shutting off the pump. The output of the pump may be used to replenish an evaporative cooling tower or other purposes.

7 Claims, 3 Drawing Sheets

CONDENSATE RECOVERY SYSTEM AND METHOD

REFERENCE TO RELATED APPLICATIONS

This application claims priority to U.S. Provisional Patent Application Ser. No. 62/511,635, filed May 26, 2017, the entire content of which is incorporated herein by reference.

FIELD OF THE INVENTION

This invention relates generally to heating, ventilation, and air conditioning (HVAC) systems and, in particular, apparatus and methods to recover and recycle water produced as a byproduct of HVAC systems.

BACKGROUND OF THE INVENTION

In some HVAC systems, such as those found in large buildings associated with arenas and hospitals, cooling towers use evaporation to cool condenser water as part of the process of making chilled water. This water has chemicals added to prevent scaling in the chiller's condenser, and as the water evaporates it must be diluted to prevent over concentration of the chemicals. Thus, potable water is used in large quantities to supply the needs of the cooling tower. Given the increasing value of potable water, any system or method to reduce consumption of potable water would be welcomed by users of such HVAC systems.

SUMMARY OF THE INVENTION

This invention is directed to a condensate recovery system adapted for use with an existing drain such as a floor drain. A condensate collection vessel, which may be funnel-shaped, is inserted into the existing drain includes an upper opening to receive condensate and an outer wall. At least a portion of the outer wall is spaced apart from the inner wall of the drain such that if the collection vessel overflows, the excess liquid flows into the drain. A float switch disposed near the upper opening of the collection vessel is operative to detect when the vessel has been filled with condensate, and a pump is operative to drain the vessel in response to the float switch detecting that the vessel has been filled with condensate.

The preferred embodiment further includes a time delay relay (TDR) in operative communication between the float switch and the pump such that the pump drains the vessel for a predetermined period of time before shutting off the pump. The output of the pump may be used to replenish an evaporative cooling tower or other purposes.

DETAILED DESCRIPTION OF THE INVENTION

This invention resides in systems and methods associated with recovering and recycling water produced as a byproduct of HVAC systems. In preferred embodiments, water is recovered at each air handling unit and pumped to a collection vessel. From there, the water can be recycled into the basin of a cooling tower, treated or used as potable water or used for irrigation.

Figure 1:
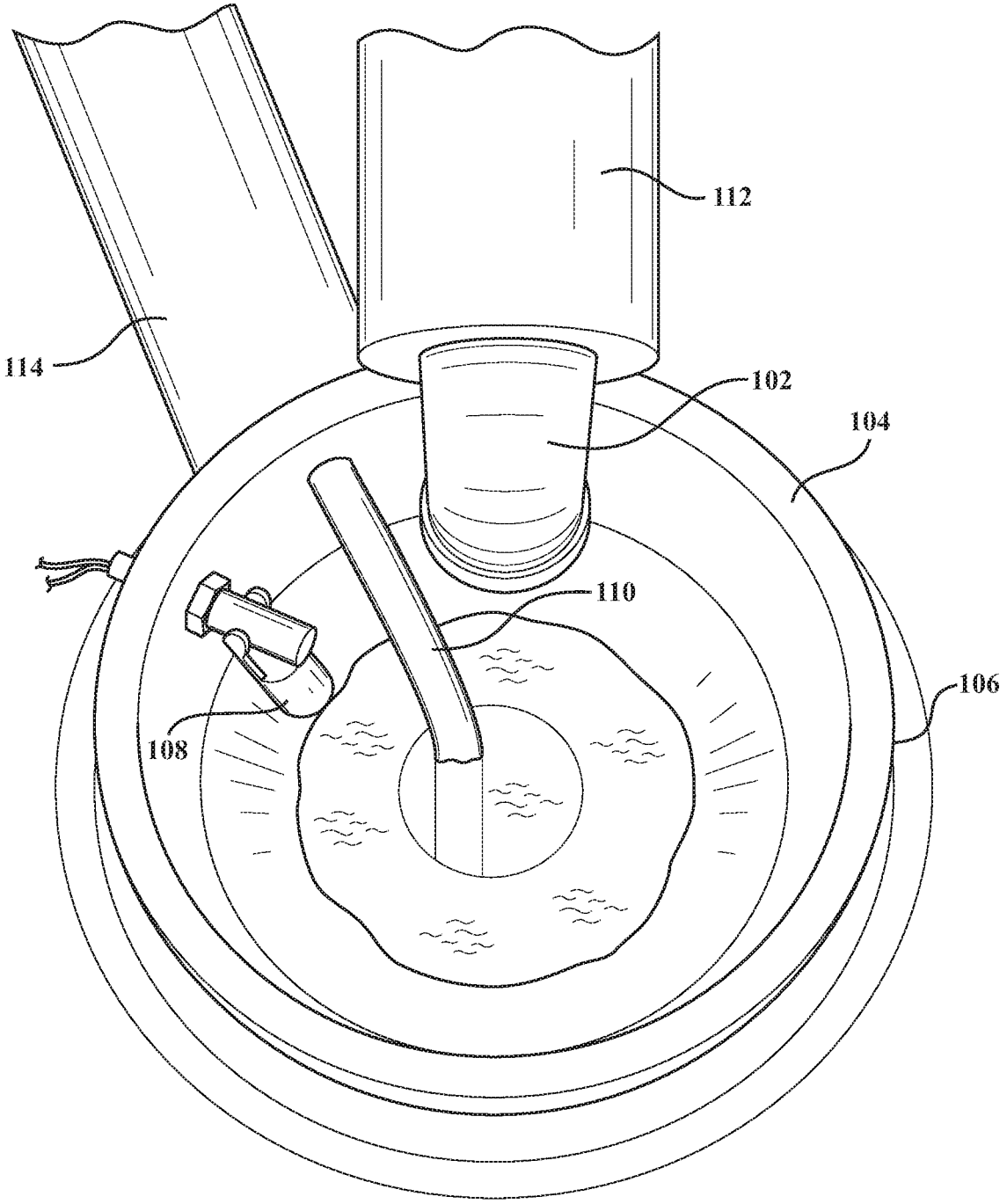
FIG. 1 is a drawing that shows how condensate from a drainage pipe is collected by a funnel-shaped insert into an existing floor drain 106.

As shown in FIG. 1, condensate drainage from pipe 102 is collected by a funnel-shaped insert 104 into an existing floor drain 106. The collection vessel 104 designed to fit inside an existing floor drain 106 to facilitate adaption to existing operational equipment. As a fail-safe measure, the floor drain will operate normally should the capture vessel overflow. That is, a gap preferably is maintained between the funnel and the existing drain so that excess liquid can pour over the top of the funnel 104 and into the drain 106.

A float switch 108 is provided in the funnel near the top thereof. In operation, condensate enters the funnel until the water level closes the float switch. A pump/control system empties the collection vessel 104 when it is full. The pump is controlled by an adjustable time delay relay (TDR) that shuts the pump down when the capture vessel becomes empty. The float switch 108 is in communication with the TDR to close the pump circuit, causing the pump to drain the funnel insert through tube 110. One or both of the pipe 102 and tube 110 may be insulated with sleeves 112, 114, respectively. The water pumped out of the funnel insert can be used for various purpose in accordance with the invention, including condensate storage, evaporation replenishing, recycling, irrigation, and so forth.

Figure 2:
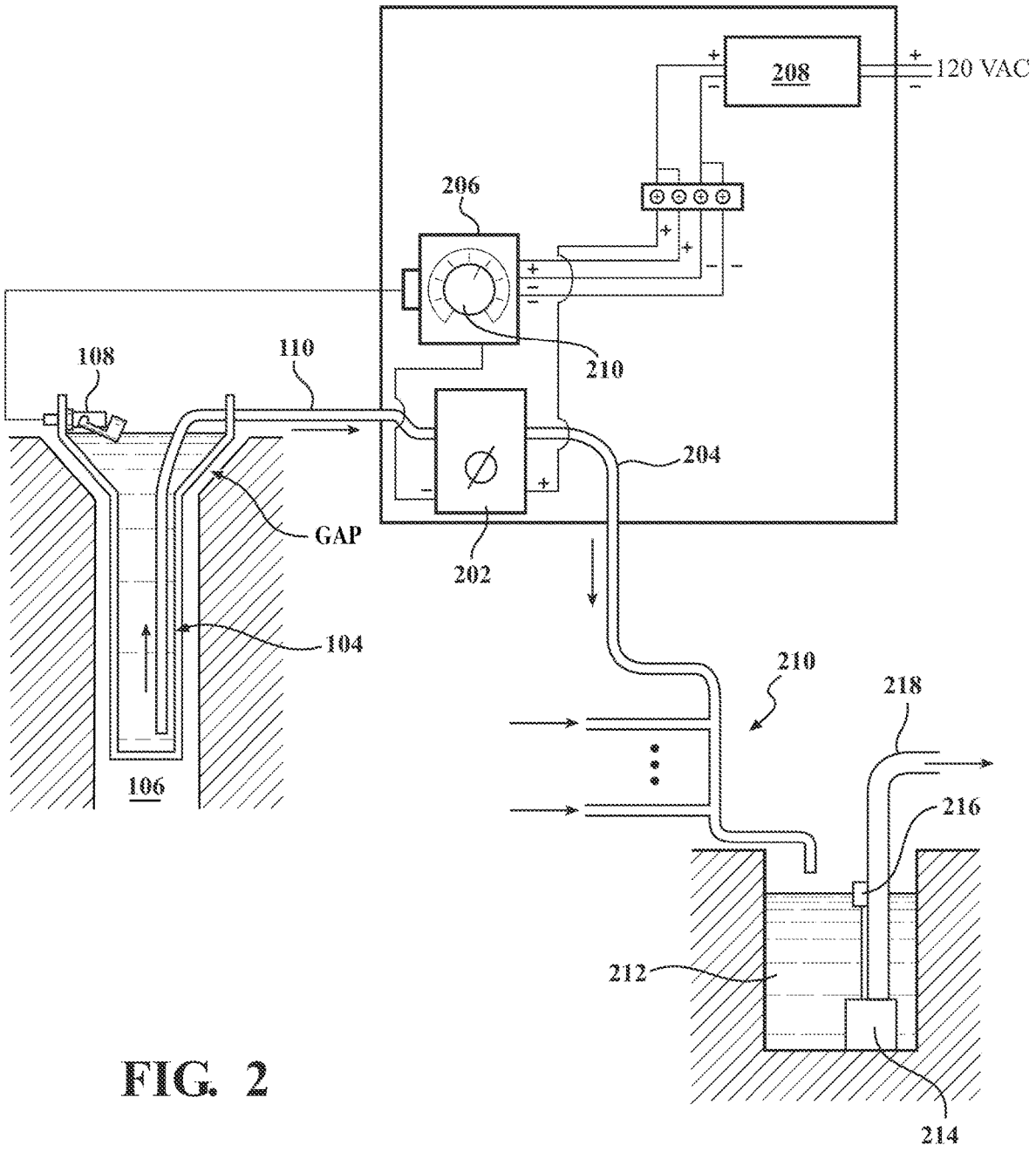
FIG. 2 is a block diagram that illustrates additional components of the preferred embodiment.

FIG. 2 is a block diagram that illustrates additional components of the system. Collected condensate from tube 110 is received by pump 202, which distributes the fluid to cooling tower(s), irrigation systems, or other applications. The TDR is shown at 206, and all active components are powered by D.C. power supply 208, typically 12 volts.

Figure 3:
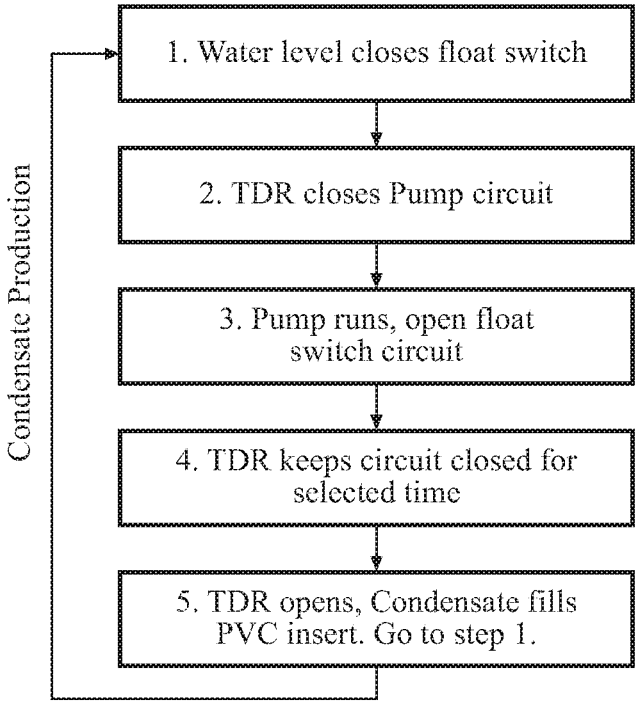
FIG. 3 illustrates how the system cycles as the insert is filled and emptied.

The TDR keeps the pump circuit active for a predetermined period of time set by the user control dial 210. Following this delay, the TDR opens the pump circuit, causing the funnel to re-fill, and the cycle repeats. At any time, if any components fail, the funnel will simply overflow into the drain until maintenance is provided. FIG. 3 illustrates the cycle. At (1), the water level in the collection vessel closes the float switch, causing the TDR to activate the pump circuit at (2). The pump runs until the float switch opens at (3), and the TDR keeps the circuit closed for the user-selected time (4). The TDR opens at (5) after the selected delay, condensate fills the PVC insert, and the cycle repeats at (1).

Referring back to FIG. 2, a drain header 204 distributes the collected condensate. While a single drain header may be used to feed a single application, in practice multiple pump panels may feed a common collection point 210, in which case a tank 212 and pump 214 may be used to distribute the water as desired. The tank 212 and pump 214 are similar to a sewage lift station, as water fills the tank 212, on/off float switch 216 cycle the pump 214 as needed, pumping the collected water out pipe 218. The tank 212 and pump 214 should be sized to the number of collection points in the system. Large systems may require multiple collection/distribution pump units. The tank 212 may be fitted with a high-level alarm which, when activated, shuts down through a relay the pump/control panels at each collection point to prevent overflow.

The system and method described herein offers many benefits to existing water recovery techniques. The water generated by the system is essentially distilled water although it has not been treated for bacteria. By adding this water into the cooling tower mix, we are reducing the amount of potable water used overall as well as the amount drained to dilute the water in the cooling tower basin.

The invention claimed is:

1. A condensate recovery system adapted for use with an existing vertically oriented stationary floor drain having an inner wall, the recovery system comprising:

a elongated condensate collection vessel configured for vertically oriented insertion into the existing drain, the condensate collection vessel having an upper opening to receive condensate, a closed bottom and an outer wall, at least a portion of the outer wall being spaced apart from the inner wall of the drain, thereby forming a gap between the outer wall of the collection vessel and the inner wall of the drain, such that such that any liquid overflowing the collection vessel flows through the gap and into the drain;

a float switch operative to detect when the vessel has filled with condensate to a predetermined level;

a conduit disposed within the vessel having a first end proximate to the closed bottom of the vessel and a second end in fluid communication with a pump external to the vessel; and wherein the pump is operative to drain the condensate from the vessel and provide the drained condensate to a remote condensate utilization device in response to the float switch detecting that the level of condensate in the vessel has reached the predetermined level.

2. The condensate recovery system of claim 1, further including a time delay relay (TDR) in operative communication between the float switch and the pump such that the pump drains the vessel for a predetermined period of time before shutting off the pump.

3. The condensate recovery system of claim 1, wherein the vessel is funnel-shaped.

4. The condensate recovery system of claim 1, wherein the remote condensate utilization device is an evaporative cooling tower.

5. The condensate recovery system of claim 1, including a common collection tank, and one or more additional collection vessels, each with a float switch and a pump having an output which feeds the common collection tank.

6. The condensate recovery system of claim 5, wherein the common collection tank includes a pump operated by a float switch.

7. The condensate recovery system of claim 5, further including an alarm causing the one or more additional collection vessels to discontinue pumping upon detection of an overfill of the common collection tank.

* * * * *